US005165040A

United States Patent [19]

Andersson et al.

[11] Patent Number: 5,165,040

[45] Date of Patent: Nov. 17, 1992

[54] PRE-STRESSED CARTRIDGE CASE

[75] Inventors: D. Mack, Mira Loma; Edward W. LaRocca, deceased, late of Placentia, all of Calif., by Mary C. LaRocca, executor

[73] Assignee: General Dynamics Corp., Air Defense Systems Division, Pomona, Calif.

[21] Appl. No.: 812,148

[22] Filed: Dec. 23, 1991

[51] Int. Cl.[5] ..... F42B 5/29; F42B 5/30

[52] U.S. Cl. ..... 102/464; 102/430; 102/466; 102/467

[58] Field of Search ..... 102/430, 464–469

[56] References Cited

U.S. PATENT DOCUMENTS

| | | | |
|---|---|---|---|
| 2,792,324 | 5/1957 | Daley et al. | 102/464 |
| 2,837,456 | 6/1958 | Parilla | 102/464 |
| 2,984,182 | 5/1961 | Fienup et al. | 102/465 |
| 3,095,813 | 7/1963 | Lipinski | 102/465 |
| 3,641,936 | 2/1972 | Barnett | 102/430 |
| 3,706,256 | 12/1972 | Grandy | 102/464 |
| 3,749,021 | 7/1973 | Burgess | 102/467 |
| 3,765,297 | 10/1973 | Skochko et al. | 102/466 |
| 3,797,396 | 3/1974 | Reed | 102/464 |
| 3,830,157 | 8/1974 | Donnard et al. | 102/464 |
| 3,977,325 | 8/1976 | Jacobsen et al. | 102/465 |
| 4,738,202 | 4/1988 | Herbert | 102/467 |
| 4,986,186 | 1/1991 | LaRocca et al. | 102/464 |
| 5,007,343 | 4/1991 | Marks | 102/290 |

*Primary Examiner*—David H. Brown

*Attorney, Agent, or Firm*—Leo R. Carroll; Henry Bissell

[57] ABSTRACT

A pre-stressed cartridge of the invention generally comprises a cylindrical liner wrapped with a plurality of layers of wound fibers or high tensile wires. These high tension wrapped windings put the walls of the cartridge liner into compression, thus pre-stressing the cylindrical liner. A cartridge constructed in this fashion may develop an ultimate strength in the circumferential direction which approaches ten times the ultimate strength of a typical solid metal cylinder alone. Special reinforcing elements may also be provided, located at the points where the maximum stress is developed upon detonation. Various modifications of this structure include fabricating the liner out of ceramic instead of aluminum, incorporating a steel cup containing the explosive at the base of the internal space of the cartridge, and combining the composite windings with the steel cup to provide a cartridge consisting of a steel cup with the rest of the cartridge being composite fiber windings.

36 Claims, 2 Drawing Sheets

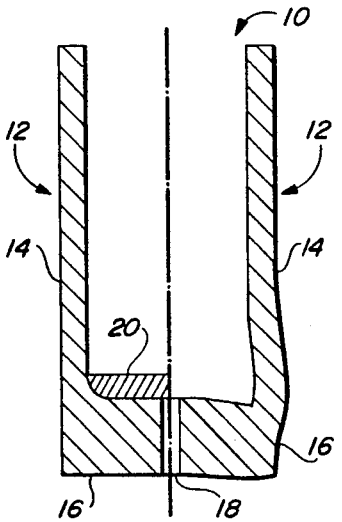
FIG. 1
(PRIOR ART)
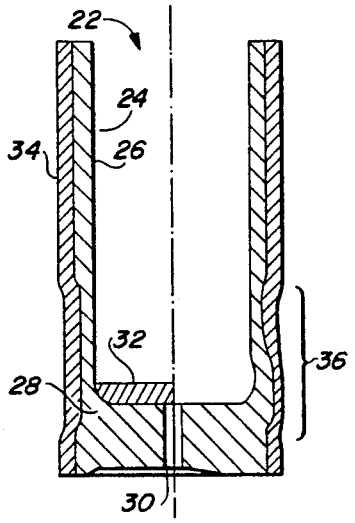
FIG. 2
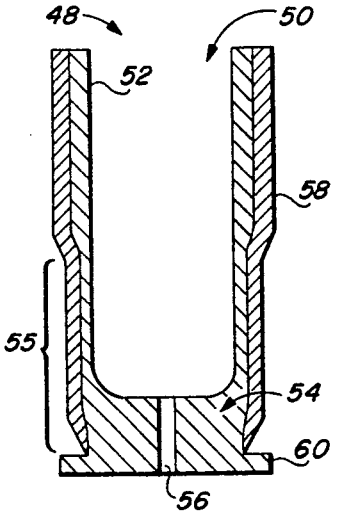
FIG. 5
FIG. 3
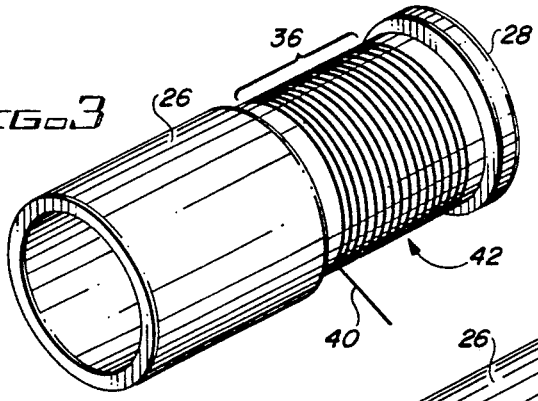
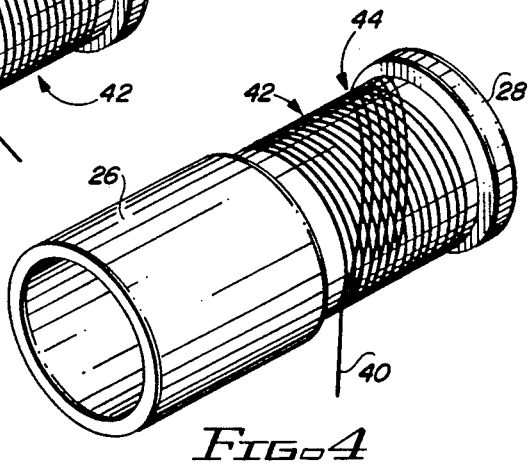
FIG. 4
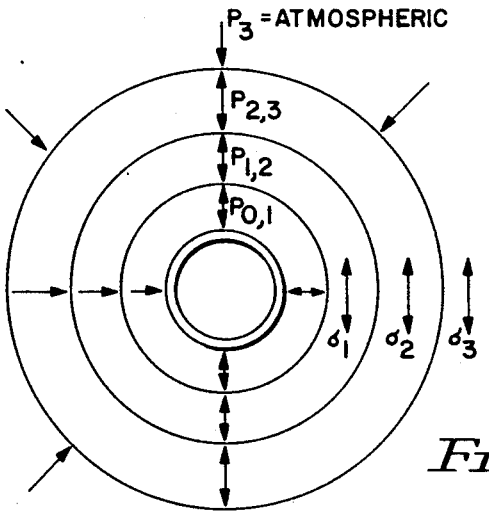
FIG. 6

PRE-STRESSED CARTRIDGE CASE

BACKGROUND OF THE INVENTION

1. Field of the Invention

The present invention relates to methods and apparatus for handling high peak pressures or shock waves in a firing chamber or gun barrel having a strength designed for a lower pressure or load and, more particularly, to arrangements for mitigating shock damage to a cartridge or casing containing explosive material when the explosive is detonated.

2. Description of the Related Art

When an explosive charge is detonated in a closed or restricted casing or cartridge, shock and/or pressure waves are produced which customarily cause an unreinforced case, container, or cavity to bulge, swell, stretch, or otherwise be deformed. This is because the shock wave from a detonation of high explosives typically induces an impulse to the cartridge that is beyond the elastic and plastic stress limits of conventional cartridge casing materials such as brass, aluminum or steel. Generally, the use of material to absorb the shock impulse prior to the shock wave hitting the cylindrical wall of the cartridge is impractical; small caliber cartridges in particular simply do not have enough volume to permit the inclusion of sufficient material to preclude deformation of the sidewall.

The strength of a cartridge case is tested most severely during firing. The pressure of the expanding gas imposes severe stresses on the cartridge case, and the case must be able to withstand the stresses without rupturing or being distorted to the extent that extraction of the case from the weapon is impeded. Another important factor in extraction, particularly in the case of automatic weapons having a high rate of fire, is elastic recovery of the cartridge case after firing. The case may be distorted for a brief time measured in small fractions of a second at the moment of burning or detonation of the charge. It is vital that the case recover from distortion to its original size very rapidly if the case is to be easily extracted from the chamber as soon as the cartridge is fired.

In conventional cartridge cases or containers, the chamber pressures are controlled by appropriate design of the reacting materials, the case or container, and the outer case, cavity or barrel. These designs are usually intended to provide a cartridge case which can be readily removed from the firing chamber after firing and replaced with another unit. This requires that no permanent deformation occur to the outer case, cavity, or barrel.

In certain outer cases, cavities, or barrels where peak design loads are low, maximum loads in the cases or containers used are accordingly limited. It would be an advance in the art of munitions and ordnance if there were a way to provide for a high-load output while using a relatively weak barrel. One particular solution to this problem is disclosed in application Ser. No. 07/265,747, now U.S. Pat. No. 4,986,186, entitled HIGH PEAK PRESSURE NOTCHED CARTRIDGE CASE, of LaRocca and Andersson, assigned to the assignee of the instant application.

The present invention involves a somewhat different approach by establishing a high-tension wrapping about the cartridge or casing to put the walls of the cartridge in compression, thereby pre-stressing the cylinder. Tee following patents are of interest in a consideration of this approach to the problem described above.

U.S. Pat. No. 2,792,324 of Daley et al discloses details of a particular procedure for winding resin impregnated yarn about a hollow container to provide a pressure vessel. Cylinders having a capacity of about 500 cubic inches were constructed which could withstand internal pressures of about 3000 pounds per square inch. Fiberglass yarn was preferred because of its high tensile strength and resistance to heat. A typical wall structure surrounding the container was composed of about 85% fiberglass and 15% insoluble resin.

U.S. Pat. No. 2,984,182 of Fienup et al discloses the formation of shot and shell tubes. This disclosure describes certain innovations introduced as departures from a conventional spiral winding technique.

U.S. Pat. Nos. 2,837,456 of Perilla, 3,706,256 of Grandy, and 4,738,202 of Hebert disclose various arrangements of composite ammunition cartridge cases in which a metal base is combined with a cylinder of resin impregnated filaments or filament reinforced plastic. Perilla and Grandy are concerned with developing a substitute for increasingly scarce strategic metals of that time, such as brass which was earlier preferred in the fabrication of artillery shell cartridge cases. Hebert discloses a design having a particular structural configuration which is directed to reducing excessive interface friction loads at the juncture between the cartridge base and cylindrical case.

U.S. Pat. No. 3,749,021 of Burgess discloses a metal-plated plastic cartridge case having a metal film between 0.05 and 0.1 mils thick plated onto a plastic cartridge case. This is done to increase the strength of the case and to improve its abrasion and burn-through resistance and its lubricity. Plastics are used in the cartridge cases of Burgess in place of brass, which is preferred, because of factors involving cost, weight and availability of the raw material.

U.S. Pat. No. 3,095,813 of Lipinski is directed to a propellant container for recoilless weapons. Lipinski discloses a container for use in a 120 mm. cartridge comprising a lamination of two resin-reinforced fiberglass layers with a plurality of helically wound wires between the layers. The wires are wound in a multiplicity of diamond-like patterns in order to promote a preferential break-up of the fiberglass cases. This arrangement is said to momentarily restrain the expansion of the propellant grains upon ignition in order to achieve the complete and efficient burning of the propellant, after which the container breaks up in preferred patterns for discharge through the venturi of the recoilless weapon.

It appears that none of these patents is directed to a solution of the particular problem addressed by the present invention.

SUMMARY OF THE INVENTION

In accordance with the present invention, a high tension wrapping of composite fibers, organic fibers, or high strength metal wires is developed about a generally cylindrical cartridge in order to put the walls of the cartridge into compression, thus pre-stressing the cylinder. Where a composite fiber wrapping around the central metal core is employed, it greatly increases the strength of the cylinder. A typical solid metal cylinder has an ultimate strength in the range of 70,000 to 100,000 pounds per square inch (psi) or 70 to 100 kilopounds per square inch (ksi). This may be improved by a factor of ten in the case of a composite-wrapped, pre-stressed cylinder which develops an ultimate strength as high as 700,000 psi in the circumferential direction.

Variation in fiber direction and in fiber modulus through the thickness of the over-wrap can be used to widen the shock pulse and more effectively contain the deformation within the cartridge. A final over-wrap of high strength, low modulus fibers permits failure of the composite underneath the final wrap, yet still allows sufficient elastic deformation to return the cartridge to its original outer shape and diameter following detonation.

In an alternative embodiment of the invention, the cylinder of the cartridge is wrapped with high strength steel or tungsten wires. As in the case of the composite fibers, the wires are put into high tension as they are wrapped around the cylinder.

It is preferable to use several layers of fiber or wire wrapping. The first wrap will preferably be oriented in a direction which is orthogonal to the cartridge axis. Succeeding wraps will be oriented at various angles to the first wrap in order to distribute the load from the detonation over a broader area of the cartridge and fiber or wire wrap, thus reducing the stress concentration in the cartridge wall. It is expected that wrapped cartridges prepared in accordance with the teaching of the present invention may be able to withstand peak pressures as high as several million psi from the detonation of the high explosive contained in the cartridge.

BRIEF DESCRIPTION OF THE DRAWINGS

A better understanding of the present invention may be realized from a consideration of the following detailed description, taken in conjunction with the accompanying drawing in which:

FIG. 1 is a schematic view, in section, of a conventional cartridge of the prior art. The left and right sides of the centerline show before and after firing views, respectively;

FIG. 2 is a corresponding sectional schematic diagram of one particular arrangement in accordance with the present invention;

FIG. 3 is a schematic perspective view of a cartridge in accordance with the present invention being wound with the first wrap of enclosing fibers or wires;

FIG. 4 is a schematic perspective view like that of FIG. 3 showing the second wrap of fibers or wires being applied;

FIG. 5 is a schematic sectional view, like those of FIGS. 1 and 2, of a second arrangement in accordance with the present invention;

FIG. 6 is a graphical diagram illustrating forces developed in the fabrication of particular arrangements in accordance with the present invention;

DESCRIPTION OF THE PREFERRED EMBODIMENTS

Figure 7:
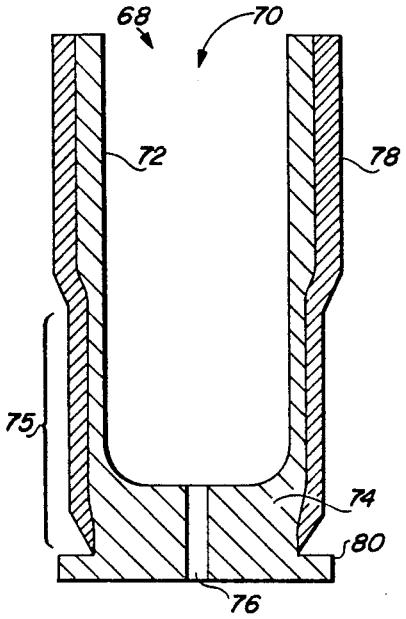
FIG. 7 is a schematic sectional view of a third arrangement in accordance with the present invention.

A conventional cartridge 10 is shown in section in FIG. 1 as comprising a hollow cylindrical shell casing 12 having sidewalls 14 joined to a base 16. Axial bore 18 in the base 16 contains the primer. The left side of the vertical centerline represents the cartridge 10 prior to detonation and shows a quantity of high explosive 20 therein. In the left side view, the cartridge is not yet deformed by firing.

The right side view shows the cartridge 10 after detonation with the wall 14 and base 16 deformed by the explosion. Detonation of the high explosive 20 causes plastic deformation to both the sidewall and base. This deformation is generally non-conducive to successive firings of the gun. The deformation causes damage to the breech and/or barrel that in minor cases results in a lack of accuracy and in major cases may result in destruction of the breech or barrel of the weapon.

FIG. 2 is a schematic sectional view similar to that of FIG. 1 illustrating a pre-stressed cartridge 22 in accordance with the present invention. This is shown comprising a liner 24 having a hollow cylindrical wall 26 joined to a base 28. The base has a central bore 30 for the primer and a quantity of explosive 32 is shown to the left of the vertical centerline in the unexploded side. The metal casing or liner 24 is shown wrapped with one or more layers of composite fibers or wires 34 which completely surround the cartridge throughout its cylindrical extent.

The right-hand side of the vertical centerline in FIG. 2 depicts the deformation which occurs after detonation of the explosive 32. Deformation of the metal liner 24 cannot be prevented. Removal of a small amount of the exterior wall, shown in the region 36, allows room for the expansion or plastic deformation of the sidewall and base. In addition, the high strength wrapping of composite fibers or wires around the cylindrical casing provides strength to the metal by pre-stressing the cylinder in compression. Thus, detonation from the high explosive must overcome both the strength of the metal and the higher strength of the windings before any damage to the breech or barrel can result. Proper construction of the pre-stressed cartridge 22 will prevent or certainly minimize any such damage.

FIGS. 3 and 4 illustrate various phases in developing a wrapping about a formed liner to fabricate a pre-stressed cartridge. FIG. 3 shows the liner 26 being wound with a filament 40 to form a first winding layer 42 about a section 36 of the liner 26 which has a reduced outside diameter as discussed previously. It will be understood that the filament 40 represents a composite fiber, an organic fiber, or any other filamentary member which is suitable for the purpose such as, for example, Kevlar or other high strength polymeric or aramid fibers. Such filamentary members may also comprise high strength metal wire such as tungsten or high strength steel wire (piano wire). In FIG. 3 the filament 40 is shown as being wound about the liner 26 with an orientation which develops the windings 42 in planes which are generally orthogonal to the axis of the cartridge. The liner 26 may be a metal composite cylinder. The filament 40 is applied under tension, preferably as the cylinder 26 is rotated in a jig so that the first wrap of filaments 42 is drawn tightly around the cylinder. The free end of the filament 40 is maintained under high tension during this winding step.

FIG. 4 shows the shift in orientation of the filament 40 to develop the second layer 44 of the wrap about the cylinder 26 at an angle to the windings of the first wrap 42. Succeeding layers of the filament wrap may be applied at different angles so that the result is a criss-cross of windings in succeeding layers which are essentially parallel to each other in a given layer but at differing angles to the winding orientation in other layers.

TEST MODEL

One particular prototype constructed as shown in FIGS. 3 and 4 is depicted in the sectional view of FIG. 5. This is a schematic sectional view of a cartridge 48 comprising a liner 50 with sidewalls 52, base 54 and primer bore 56 and a filamentary winding 58. Design details of one particular cartridge embodying the present invention as shown in FIG. 5 are set forth herein. This is a carbon-fiber wrapped aluminum cartridge. The aluminum was used to provide stiffness and to mitigate the first shock from the detonation. The carbon-fiber wrap was used to provide a high strength container to absorb the shock energy.

This cartridge design is an evolution of a wire-wrapped cartridge. The carbon fiber adds considerable strength to the cartridge, while allowing for a much lighter design as contrasted with more conventional brass and steel cartridges.

The basic design of the cartridge 48 is shown in FIG. 5. 6061-T6 aluminum was overwrapped circumferentially with a graphite-epoxy composite. The aluminum was used as a shock mitigator for the carbon fiber and provided an extractor lip 60 for the gun breech.

The details of the composite are given below:

FIBER:

Hercules AS4 graphite fibers, 12 K filaments per bundle.

Advertised dry strength—550 ksi tensile.

Advertised dry modulus—34 msi (million pounds per square inch).

Tensile strain—1.5%

MATRIX:

Dow Chemical DER 332 resin with Jeffamine T-403 curing agent.

Cure Temp—50° C. overnight

The fibers 58 were circumferentially wound on the aluminum cartridge 50 in the manner indicated in FIG. 3 to form three layers of progressively reduced tension. A diagram of the composite overwrap indicating stress and pressure distribution is shown in FIG. 6. The first layer was wrapped with 7 pounds of tension, the second with 5 pounds, and the third with 4 pounds. The ultimate strength of the composite part of the cartridge, assuming a 60% "stress free" circumferential fiber volume and excluding the matrix, is calculated to be: $0.60\times550$ ksi$=330$ ksi. Pre-stressing the carbon fibers will reduce the overall strength. Assuming a $7\mu$ ($7.0\times10^{-6}$ m) filament diameter, $3.848\times10^{-11}$ m$^2$ area, the 12 K fiber diameter is: (12,000) $(3.848\times10^{-11})=4.618\times10^{-7}$ m$^2=7.10\times10^{-4}$ in$^2$.

The 7 pound tension that is initially imparted to the fiber corresponds to an initial fiber stress of 9.25 ksi. The subsequent layers reduce this tension while increasing the overall compressive stress imparted to the aluminum cartridge. Using thin wall cylinder theory:

stress, $\sigma=PR/T$ where:

$\sigma=9.25$ ksi

P=internal pressure

R=radius=0.703 in.

T=layer thickness $\approx0.027$

Therefore: Initial external pressure imparted on the aluminum cartridge=355 psi.

When additional overwrap layers of the same thickness and modulus are applied, the stress in the first layer is reduced by inter-layer compressive force imparted by the overwrapped layers.

For the three-layer composite overwrap comprising three layers of winding about an aluminum cylinder wherein the transwinding pressures are designated according to FIG. 6:

$$P_{2,3}=P_3+\sigma_3T/R_3$$

$$P_{1,2}=P_{2,3}+\sigma_2T/R_2$$

$$P_{0,1}=P_{1,2}+\sigma_1T/R_1$$

$P_3$ (at outer surface)=atmospheric pressure

The final stress in layer 1=initial stress—($P_{1,2}$) (R2/T2). The final stress in layer 2=initial stress—($P_{2,3}$) (R3/T3). For this cartridge:

$R_1=0.730$ $R_2=0.757$ $R_3=0.784$

| | Initial Stress | Final Stress |
|---|---|---|
| layer 1 | 9.86 ksi | 3.01 ksi |
| layer 2 | 7.04 ksi | 1.44 ksi |
| layer 3 | 5.63 ksi | 5.63 ksi |

The 6.85 ksi reduction in the circumferential stress in layer 1 is accompanied by a reduction in circumference of:

$$\text{circumferential strain} = 6.85\times10^3/(.6)\,(35\times10^6) = 3.26\times10^{-4}\ \text{in/in}$$

This acts to further increase the circumferential compressive stress on the aluminum portion of the cartridge from its initial 2.95 ksi pre-stress. This additional stress is equal to $(3.26\times10^{-4}$ in/in$)$ $(10\times10^6$ psi$)=3.26$ ksi. The overall circumferential compressive stress in the aluminum is 6.21 ksi. The final pre-stress in the cartridge components is given by:

ALUMINUM radial stress=355 psi compression circumferential stress=6.21 ksi compression

COMPOSITE

1st layer

$\sigma_r=245$ psi compression $\sigma_\phi=3.01$ ksi tension

2nd layer

$\sigma_r=195$ psi compression $\sigma_\phi=1.44$ ksi tension

3rd layer

$\sigma_r=0$ $\sigma_\phi=5.63$ ksi tension

The above analysis is a simplified first order analysis that does not take into account the effect of compression on the individual fiber layers which, when used with Poisson's ratio, will change the magnitude of the internal layer stresses. It also does not take into account the fiber relaxation that typically occurs during curing nor the effect of the curing temperature on the materials which have different coefficients of thermal expansion. Qualitatively, the aluminum has a much higher coefficient of thermal expansion than the graphite overwrap. As the temperature rises, the aluminum will expand more and increase the fiber overwrap stresses during cure if, and only if, tension in the fibers is held and the resin is locked in. Usually considerable stress relaxation and resin flow occurs to a point of being nearly stress free at the cure temperature. When the composite is cooled, the aluminum will contract more than the composite and the interface between the two will be in tension.

CARTRIDGE STRENGTH

The circumferential compressive pre-stress on the aluminum is approximately 17.7% of its 35 ksi compressive strength. The composite overwrap layers are stressed in tension to a maximum of 1.5% of their tensile strength of 330 ksi. The carbon fibers also have a 1.5% strain-to-failure elongation. This predicts that the inner composite layer will fail when it expands radially 0.011 inch (0.022 inch on the diameter).

A 1.5% strain on the aluminum corresponds to a tensile stress slightly greater than the tensile yield strength of 40 ksi but does not fail ultimately in tension.

The overall circumferential tensile failure strength of the cartridge in the recessed region 55 (see FIG. 5) is:

$$\frac{(.08)(40ksi) + (.09)(330ksi)}{.170} = 194ksi$$

At 194 ksi tensile ultimate strength, the cartridge is capable of an internal static pressure of 46,913 psi.

Although the circumferential strength is excellent, the radial compressive strength is extremely poor, and is limited to the room temperature compressive strength of the aluminum at 35 ksi, corresponding to a static internal pressure of 35 ksi.

In review of this design, the aluminum liner will fail compressively before the composite overwrap fails in tension. This condition is confirmed upon examination of the eroded region of the aluminum portion of the spent cartridge after firing. The deformation was evident and it was apparent that the aluminum failed due to compression and was heated toward a tensile failure in the base. There was also significant deformation in the hoop direction. The cartridge required about 1200 ft-lbs to eject it from the barrel, which was also deformed by the shot.

An alternative embodiment of the invention is shown in FIG. 7. This is like FIG. 5 except that the liner is made of ceramic instead of metal. Ideally, a high compressive strength ceramic liner could be used to absorb the initial highly erosive compressive pressure pulse. Such a cartridge 68 is shown in FIG. 7 as comprising a ceramic liner 70 having sidewalls 72, a base 74, a reduced diameter section 75 encompassing the base, a primer bore 76, an overwrap 78 and an extractor lip 80.

The expected performance of the cartridge 68 under firing conditions is described as follows. As the detonation pulse travels through the cartridge wall, the compressive stress is reduced to zero at the outer radius. The interface between the ceramic and reinforcement will reflect some of the pressure pulse back into the ceramic as tension and transmit the remainder as a radial compression stress, and circumferential tensile stress in the outer reinforcement. The reflected tensile pulses will fragment the ceramic liner due to the ceramic's inherently low tensile properties. Provided that the outer reinforcement can withstand the deformation elastically, no permanent deformation will occur since the liner has been destroyed.

The destruction of the ceramic liner will produce extremely hazardous particulates capable of extreme bodily harm if discharged from the cartridge. It may be appropriate to include particulate containment elements in conjunction with cartridges employing ceramic liners as described herein.

Another arrangement which constitutes an alternative to the cartridge with the aluminum casing, as shown in FIG. 5, involves installing a thin ring of steel inside the aluminum blank. Such a modification is shown in the sectional view of FIG. 8 as comprising a cartridge 81 having an aluminum liner 82 with sidewalls 83, base 84 and extractor lip 85. The base has an axial bore 86. A layer of windings 88 is provided in a fashion similar to that of the previous embodiments of the invention. The liner 82 comprising the aforementioned elements is constructed of 6061-T6 aluminum as in the case of the embodiment of FIG. 5. In addition, the cartridge 81 includes a thin steel ring 89 extending about the interior wall 83 in a region adjacent the base 84. The steel ring 89 should provide the mass/strength to mitigate the initial shock impulse due to its higher compressive strength and higher modulus. Since the steel has a higher modulus than the aluminum, the peak of the shock wave in the aluminum will not be as sharp as the shock through the steel, thus lowering the erosion potential of the shock wave.

Figure 9:
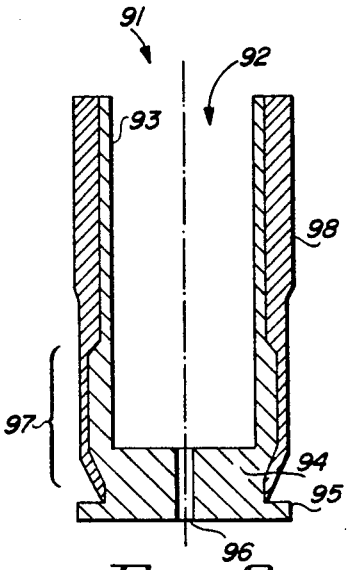
FIG. 9 is a schematic sectional view of a fifth arrangement in accordance with the present invention.

Another alternative embodiment of the invention is depicted in FIG. 9. This shows a cartridge 91 having a liner 92, a base 94 and extractor lip 95. There is also a central primer bore 96 and the multiple winding overwrap 98 surrounding the liner 92. Comparing the cartridge 91 of FIG. 9 with the cartridge 48 of FIG. 5 it will be noted that a substantially thicker portion of the liner 92 is provided adjacent the base 94. This portion, designated 97 in the drawing, overlaps the major portion of the base 94 and approximately 30% of the sidewall 93 adjacent the base 94. In addition to providing reinforcement in the region 97, the area where the most severe erosion has been found to occur in test firings of aluminum liner cartridges such as that shown in FIG. 5, the liner is further strengthened by using a stronger aluminum material, such as that bearing the designation 7075-T6. The thicker aluminum provides more mass to absorb the shock. The 7075-T6 aluminum has a higher yield and ultimate strength that will help withstand the detonation.

Figure 8:
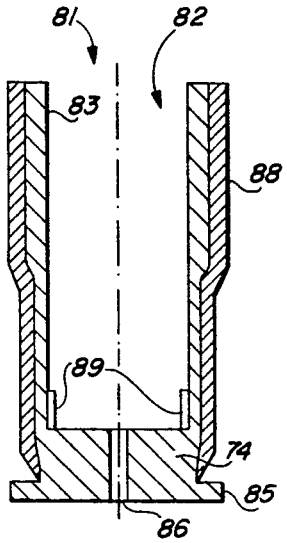
FIG. 8 is a schematic sectional view of a fourth arrangement in accordance with the present invention.
Figure 10:
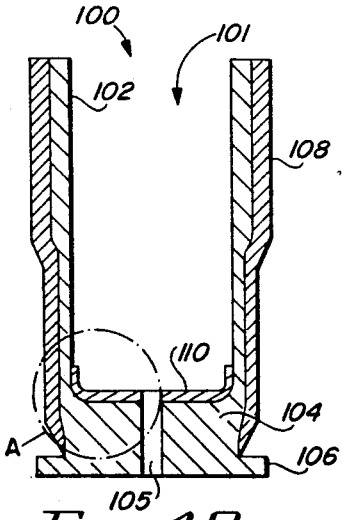
FIG. 10 is a schematic sectional view of a seventh arrangement in accordance with the present invention.
Figure 11:
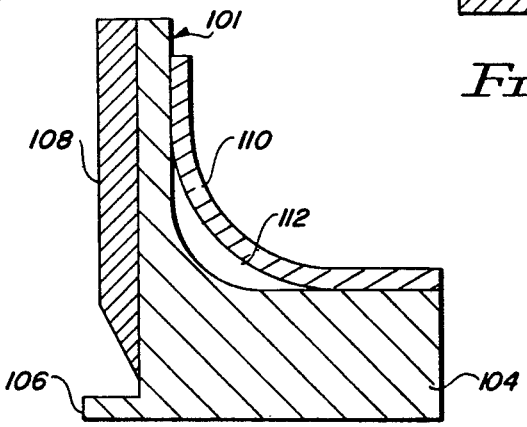
FIG. 11 is an enlarged view of a portion of FIG. 10.

Another embodiment of the invention which may be considered an extension of the principle disclosed in conjunction with FIG. 8 is depicted in FIG. 10. This shows a cartridge 100 having a liner 101 with sidewalls 102, base 104 and extractor lip 106. The reinforcing winding 108 is shown surrounding the liner 101 and base 104. A steel cup 110 is shown at the bottom of the wall formed by the liner 101. This steel cup 110 is shaped similarly to an automobile engine freeze plug and is designed to alleviate the tensile failure problem in the base of the cartridge, as well as the compressive erosion along the sidewall of the aluminum liner. The interface between the steel and the aluminum will reflect some of the shock wave similarly to the steel band of FIG. 8. As indicated in FIG. 11, which is an enlarged view of the portion within the circle A of FIG. 10, there is a slight air space around the internal corner of the liner. Although its extent may be exaggerated in FIG. 11, the airspace 112 around the internal corner, as shown in FIG. 11 will allow the steel cup to deform backwards as the shock wave is propagating through the steel into the aluminum. This motion will spread the shock over a larger area of the aluminum, again minimizing the erosive wave front.

Adding the internal steel cup also has the advantage that the explosive can be cast and cured in the cup as well as stored and handled more easily.

Figure 12:
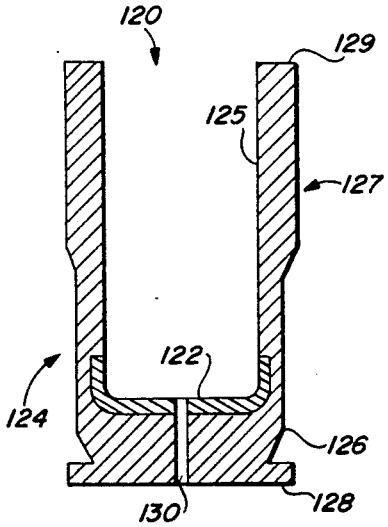
FIG. 12 is a schematic sectional view of an eighth arrangement in accordance with the present invention.

FIG. 12 shows a sectional view of still another embodiment of the present invention. In FIG. 12, a cartridge 120 comprises a steel cup 122 and a composite fiber portion 124. The portion 124 includes base portion 126 having an extractor lip 128 and primer bore 130 formed integrally with the cylinder portion 127. Thus the composite fiber portion 124 includes a first plurality of windings wound circumferentially in side-by-side relationship to form a cylindrical liner 125 and a second plurality of windings wound continuously with said first plurality and extending thereover in at least one layer 129 applied under predetermined tension to pre-stress the cylindrical liner. In this embodiment the entire cartridge, with the exception of the high strength steel cup 122, is made of composite fiber material. The cup 122 is made of steel, such as 4340, with an ultimate strength of 275–300 ksi. The steel absorbs the initial shock while the composite fibers provide the needed strength.

Although there have been shown and described hereinabove specific arrangements of a pre-stressed cartridge case in accordance with the invention for the purpose of illustrating the manner in which the invention may be used to advantage, it will be appreciated that the invention is not limited thereto. Accordingly, any and all modifications, variations, or equivalent arrangements which may occur to those skilled in the art should be considered to be within the scope of the invention as defined in the annexed claims.

What is claimed is:

1. A pre-stressed cartridge case for containing high explosive for detonation in a weapon comprising:

a generally cylindrical liner having a hollow tube-shaped portion open at a first end and joined to a base portion at a second end thereof, said base portion being oriented transversely to the longitudinal axis of the cylindrical liner and serving to substantially close said second end; and a plurality of windings extending about the cylindrical liner in side-by-side relationship to form at least one layer of windings, said windings being formed of a continuous filamentary member successively wound about the liner under a tension maintained during the winding process sufficient to pre-stress the liner in compression;

wherein said plurality of windings forms a plurality of layers, each layer comprising a multiplicity of windings, the windings of each layer being oriented in planes generally orthogonal to the longitudinal axis of the cylindrical liner; and wherein the layers of windings are three in number, the windings of each layer being wound with different degrees of tension from layer to layer.

2. The device of claim 1 wherein the layers of said plurality overlie one another with the windings of each layer being maintained in tension sufficient to pre-stress the liner in compression.

3. The device of claim 1 wherein the material of the cylindrical liner is metal.

4. The device of claim 1 wherein the material of the cylindrical liner is ceramic.

5. The device of claim 1 wherein said filamentary member comprises carbon fibers.

6. The device of claim 1 wherein said filamentary member comprises a graphite-epoxy composite.

7. The device of claim 1 wherein said filamentary member comprises Kevlar.

8. The device of claim 1 wherein said filamentary member comprises a high strength polymeric fiber.

9. The device of claim 1 wherein said filamentary member comprises a high strength aramid fiber.

10. The device of claim 1 wherein said filamentary member comprises tungsten wire.

11. The device of claim 1 wherein said filamentary member comprises high strength steel wire.

12. The device of claim 1 further comprising a reinforcing cup mounted adjacent the base portion and extending substantially across the tube-shaped portion, said cup having a raised lip which extends longitudinally from the base portion.

13. The device of claim 1 wherein the windings about the cylindrical liner are formed along the full extent of the cartridge case.

14. The device of claim 1 wherein the base portion of the cylindrical liner includes an annular extractor lip and the windings extend about the cylindrical liner from the exterior lip to the first end of the tube-shaped portion.

15. The device of claim 1 wherein the cylindrical liner is formed with a portion of reduced diameter about which the windings are wrapped.

16. The device of claim 1 wherein the tension maintained during winding is greatest for the innermost layer and least for the outermost layer.

17. The device of claim 16 wherein the first layer is wrapped with seven pounds of tension, the second layer is wrapped with five pounds of tension, and the third layer is wrapped with four pounds of tension.

18. A pre-stressed cartridge case for containing high explosive for detonation in a weapon comprising:

a generally cylindrical liner having a hollow tube-shaped portion open at a first end and joined to a base portion at a second end thereof, said base portion being oriented transversely to the longitudinal axis of the cylindrical liner and serving to substantially close said second end; and a plurality of windings extending about the cylindrical liner in side-by-side relationship to form at least one layer of windings, said windings being formed of a continuous filamentary member successively wound about the liner under a tension maintained during the winding process sufficient to pre-stress the liner in compression;

wherein the material of the cylindrical liner is metal; and further including a metal reinforcing band positioned in tightly fitting relationship inside the tubular portion adjacent the base portion.

19. The device of claim 18 wherein said plurality of windings forms a plurality of layers, each layer comprising a multiplicity of windings, the windings of one layer being wound at a different angle relative to the longitudinal axis of the cylindrical liner from the angle of the windings in another layer.

20. The device of claim 18 wherein the windings of the radially innermost layer adjacent the outer surface of the tube-shaped portion of the cylindrical liner are oriented in planes generally orthogonal to the longitudinal axis of the cylindrical liner.

21. The device of claim 18 wherein said band is steel and said cylindrical liner is formed of aluminum.

22. The device of claim 18 wherein the cylindrical liner is generally cup-shaped and wherein the windings extend in a first direction along the longitudinal axis to form an augmented base portion and in a second direction along the longitudinal axis to develop a longitudinal extension of the tube-shaped portion of the liner.

23. The device of claim 18 wherein said cylindrical liner is formed of aluminum.

24. The device of claim 23 wherein the cylindrical liner is formed of 6061-T6 aluminum.

25. The device of claim 23 wherein the cylindrical liner is formed of 7075-T6 aluminum.

26. A pre-stressed cartridge case for containing high explosive for detonation in a weapon comprising:

a generally cylindrical liner having a hollow tube-shaped portion open at a first end and joined to a base portion at a second end thereof, said base portion being oriented transversely to the longitudinal axis of the cylindrical liner and serving to substantially close said second end;

a plurality of windings extending about the cylindrical liner in side-by-side relationship to form at least one layer of windings, said windings being formed of a continuous filamentary member successively wound about the liner under a tension maintained during the winding process sufficient to pre-stress the liner in compression; and further comprising a reinforcing cup mounted adjacent the base portion and extending substantially across the tube-shaped portion, said cup having a raised lip which extends longitudinally from the base portion;

wherein the cylindrical liner comprises an additional plurality of windings extending circumferentially in side-by-side relationship to form at least one layer of windings, the windings of said additional plurality being formed of said continuous filamentary member such that the entire cartridge case except for said cup is made of continuously wound, composite fiber material.

27. The device of claim 26 wherein said reinforcing cup is fabricated of steel and shaped to form an annular space between the outer curved portion of the cup and the juncture of the base portion and tubular portion of the liner.

28. A pre-stressed cartridge case for containing high explosive for detonation in a weapon comprising:

a generally cylindrical liner having a hollow tube-shaped portion open at a first end and joined to a base portion at a second end thereof, said base portion being oriented transversely to the longitudinal axis of the cylindrical liner and serving to substantially close said second end; and a plurality of windings extending about the cylindrical liner in side-by-side relationship to form at least one layer of windings, said windings being formed of a continuous filamentary member successively wound about the liner under a tension maintained during the winding process sufficient to pre-stress the liner in compression;

wherein the cylindrical liner is formed with a portion of reduced diameter about which the windings are wrapped; and wherein the portion of reduced diameter is adjacent the first end of the tube-shaped portion and wherein the remainder of the tubular portion and at least an adjacent segment of the base portion are formed with an increased outer diameter to develop a thicker wall section for the remainder of the tubular portion.

29. The device of claim 28 wherein the portion of reduced diameter is adjacent the base portion and includes at least a segment of the base portion.

30. The device of claim 28 wherein the thickness of the wrap of windings about the cylindrical liner is reduced in the region of the thicker wall section of the liner relative to the thickness of the wrap around the reduced diameter portion of the cylindrical liner.

31. A pre-stressed case for containing high explosive for detonation in a weapon comprising:

a cylindrical metal casing including a hollow tube-shaped portion integrally formed with a base portion, said base portion closing one end of the tube-shaped portion except for a primer bore along the longitudinal axis thereof; and a plurality of filamentary windings wrapped about the casing and being arranged in layers;

wherein said windings are wrapped under tension sufficient to pre-stress the casing in compression; and wherein the windings of all layers are oriented circumferentially about the cylindrical casing;

said plurality being three layers of windings with the innermost layer being wound with the greatest tension and the outermost layer being wound with the least tension.

32. The device of claim 31 wherein the windings of each layer are oriented in a different direction about the casing relative to the windings in other layers.

33. The device of claim 31 further including a reinforcing cup mounted within the tube-shaped portion of the casing adjacent the base portion to provide reinforcement at the juncture between the tube-shaped portion and the base portion.

34. The device of claim 33 wherein said casing is formed of aluminum and said cup is formed of steel.

35. The device of claim 31 further including a reinforcing steel band mounted within the tube-shaped portion of the casing adjacent the base portion to provide reinforcement at the juncture between the tube-shaped portion and the base portion.

36. The device of claim 35 wherein said casing is formed of aluminum and said band is formed of steel.

* * * * *

UNITED STATES PATENT AND TRADEMARK OFFICE

CERTIFICATE OF CORRECTION

PATENT NO. : 5,165,040
DATED : November 17, 1992
INVENTOR(S) : Norman D. Andersson, et. al.

It is certified that error appears in the above-indentified patent and that said Letters Patent is hereby corrected as shown below:

Title page, item [75], inventors: should read as followings:
Norman D. Andersson, Alta Loma;
S. D. Mack, Mira Loma;
Edward W. LaRocca, deceased, late of Placentia,
by Mary C. LaRocca, executor, all of California Signed and Sealed this Twenty-sixth Day of April, 1994

*Attest:*

Bruce Lehman

BRUCE LEHMAN

*Attesting Officer*

*Commissioner of Patents and Trademarks*